US009188322B2

(12) United States Patent
Lan

(10) Patent No.: US 9,188,322 B2
(45) Date of Patent: Nov. 17, 2015

(54) HEAT DISSIPATION STRUCTURE FOR LED LIGHTING

(75) Inventor: Wen-Ji Lan, New Taipei (TW)

(73) Assignee: ASIA VITAL COMPONENTS CO., LTD., New Taipei (TW)

( * ) Notice: Subject to any disclaimer, the term of this patent is extended or adjusted under 35 U.S.C. 154(b) by 5 days.

(21) Appl. No.: 13/429,971

(22) Filed: Mar. 26, 2012

(65) Prior Publication Data

US 2013/0250578 A1 Sep. 26, 2013

(51) Int. Cl.
*F21V 29/02* (2006.01)
*F21K 99/00* (2010.01)

(52) U.S. Cl.
CPC *F21V 29/02* (2013.01); *F21K 9/137* (2013.01)

(58) Field of Classification Search
CPC ..... F21V 17/00; F21V 17/005; F21V 29/00; F21V 29/002; F21V 29/02; F21V 19/00; F21V 29/027; F21V 29/60; F21V 29/61; F21V 29/67; F21V 29/673; F21V 29/677; F21V 9/02; F21K 9/137
See application file for complete search history.

(56) References Cited

U.S. PATENT DOCUMENTS 7,144,135 B2 * 12/2006 Martin et al. ..... 362/294
8,164,237 B2 * 4/2012 Wen ..... 313/46
2005/0174780 A1 * 8/2005 Park ..... 362/294
2006/0193139 A1 * 8/2006 Sun et al. ..... 362/373
2006/0215408 A1 * 9/2006 Lee ..... 362/294
2008/0212333 A1 * 9/2008 Chen ..... 362/373
2009/0046465 A1 * 2/2009 Hashimoto et al. ..... 362/294
2009/0059559 A1 * 3/2009 Pabst et al. ..... 362/84
2010/0060132 A1 * 3/2010 Liu et al. ..... 313/46
2010/0061098 A1 * 3/2010 Horng et al. ..... 362/253
2010/0124058 A1 * 5/2010 Miller ..... 362/249.02
2010/0165632 A1 * 7/2010 Liang ..... 362/294
2010/0259934 A1 * 10/2010 Liu et al. ..... 362/294
2011/0037368 A1 * 2/2011 Huang ..... 313/46
2011/0109215 A1 * 5/2011 Choi et al. ..... 313/45
2011/0181165 A1 * 7/2011 Lin et al. ..... 313/46
2011/0204790 A1 * 8/2011 Arik et al. ..... 315/113
2012/0008330 A1 * 1/2012 Horng et al. ..... 362/373
2012/0033419 A1 * 2/2012 Kim et al. ..... 362/235
2012/0062095 A1 * 3/2012 Horng ..... 313/46
2012/0146481 A1 * 6/2012 Li et al. ..... 313/46
2012/0250335 A1 * 10/2012 Nakano ..... 362/382
2015/0138780 A1 * 5/2015 Yoshizawa et al. ..... F21V 29/83

* cited by examiner

*Primary Examiner* — Thomas A Hollweg
*Assistant Examiner* — Christopher Raabe

(57) ABSTRACT

A heat dissipation structure for LED lighting includes a light seat, a support body, a cap body and a lens. A heat sink and a fan are assembled on the support body and disposed in the opening of the light seat. The cap body has a first open end and a second open end. At least one air outlet is formed on the cap body in adjacency to the first open end. At least one air inlet is formed on the cap body at the second open end. The fan serves to forcedly drive airflow from the air inlet into the light seat and then drive the airflow to multiple radiating fins of the heat sink so as to directly carry the heat from the radiating fins to outer side through the air outlet. Accordingly, the heat dissipation effect is enhanced and the noise is reduced.

8 Claims, 11 Drawing Sheets

HEAT DISSIPATION STRUCTURE FOR LED LIGHTING

BACKGROUND OF THE INVENTION

1. Field of the Invention

The present invention relates generally to a heat dissipation structure for LED lighting, and more particularly to a heat dissipation structure for LED lighting, which has better heat dissipation effect and is able to reduce noise.

2. Description of the Related Art

Recently, various green products meeting the requirements of energy saving and carbon reduction have been more and more respected. Following the rapid advance of manufacturing technique of light-emitting diode (hereinafter abbreviated as LED), various LED products have been widely applied in various fields as illumination devices, such as LED car lights, LED streetlights, LED desk lamps and LED lightings.

When high-power LED emits light, LED also generates high heat. The heat must be efficiently dissipated. Otherwise, the heat will locally accumulate where the light-emitting component is positioned to cause rise of temperature. This will affect the normal operation of some components of the product or even the entire product and shorten the lifetime of the product.

Taking a conventional LED lighting as an example for illustration, the conventional LED lighting lacks any heat dissipation structure for dissipating the heat. Therefore, after a long period of use, the heat generated by the LED will accumulate in the LED lighting without being effectively dissipated. This will lead to burnout of the LED due to overheating. To solve this problem, some manufacturers have developed various heat dissipation structures with for LED lightings.

Please refer to FIGS. 1*a*, 1*b* and 1*c*. FIG. 1*a* is a perspective exploded view of a conventional heat dissipation structure for LED lighting. FIG. 1*b* is a perspective assembled view of the conventional heat dissipation structure for LED lighting. FIG. 1*c* is a perspective view of a part of the conventional heat dissipation structure for LED lighting, seen from another angle. The conventional heat dissipation structure for LED lighting includes a light seat 10, a cap body 11 and a lens 12. A drive circuit 101 is disposed in the light seat 10. The cap body 11 has an open end 111 and is capped on the light seat 10. The cap body 11 has an internal support section 112. Multiple air inlets 113 are formed on the support section 112 between the cap body 11 and the support section 112. Multiple radiating fins 114 are formed on one side of the support section 112, which side is proximal to the light seat 10. A fan 115 is disposed on the side of the support section 112. The rear ends of the radiating fins 114 are annularly connected with each other. The center of the support section 112 is formed with an air outlet 116. The air outlet 116 extends from the other side of the support section 112 in a direction away from the radiating fins 114. An LED module 13 is fitted on the air outlet 116. One side of the LED module 13 is attached to the support section 112. The lens 12 is assembled on the cap body 11. The lens 12 is formed with a central hole 121 in alignment with the air outlet 116. The lens 12 is assembled and connected with the LED module 13.

Please now refer to FIG. 1*d*, which is a sectional view showing the operation of the conventional heat dissipation structure for LED lighting. When the LED module 13 emits light and generates high heat, the support section 112 and the radiating fins 114 will absorb the heat. In the meantime, the fan 115 operates to suck the ambient airflow of the LED lighting into the cap body 11. The fan 115 will forcedly drive the airflow toward the radiating fins 114. When the airflow reaches the radiating fins 114, the airflow will carry away the heat from the radiating fins 114. The hot wind is guided from the radiating fins 114 to the central air outlet 116 and sent out to dissipate the heat of the LED module 13.

According to the above, the conventional heat dissipation structure for LED lighting is able to dissipate the heat generated by the LED module 13. However, the heat dissipation effect is poor. This is because when the fan 115 drives the airflow to the radiating fins 114, the support section 112 will stop the airflow to affect the heat dissipation efficiency. As a result, the heat generated by the LED module 13 can be hardly effectively dissipated and the LED module 13 is likely to overheat. In some slight cases, the illumination of the LED lighting will be deteriorated and the lifetime of the LED lighting will be shortened. In some serious cases, the LED module 13 may damage (burn out). Moreover, the airflow is stopped, the LED lighting will make a noise. Furthermore, the air outlet 115 is not provided with any design for preventing alien articles from entering the light seat 10. As a result, alien articles may directly enter the light seat 10 from the air outlet 116 to affect the operation of the fan 115.

According to the above, the conventional heat dissipation structure for LED lighting has the following shortcomings:

1. The heat dissipation effect is poor.
2. The noise is increased.
3. The illumination of the LED lighting is likely to be deteriorated and the lifetime of the LED lighting is shortened.
4. Alien articles are likely to enter the light seat from the air outlet to affect the operation of the fan.

SUMMARY OF THE INVENTION

A primary object of the present invention is to provide a heat dissipation structure for LED lighting, which has better heat dissipation effect and is able to reduce noise.

A further object of the present invention is to provide the above heat dissipation structure for LED lighting, which is able to prevent alien articles from entering the LED lighting.

A still further object of the present invention is to provide the above heat dissipation structure for LED lighting, which is able to guide the airflow to lower the wind pressure at the air outlet and increase air volume.

To achieve the above and other objects, the heat dissipation structure for LED lighting of the present invention includes: a light seat formed with an opening; a support body disposed in the opening of the light seat, a heat sink and a fan being assembled and disposed on the support body, an LED module being assembled and disposed on the heat sink; a cap body capped on the support body and disposed in the opening of the light seat, the cap body having a first open end and a second open end, at least one air outlet being formed on the cap body in adjacency to the first open end, at least one air inlet being formed on the cap body at the second open end; and a lens disposed in the first open end. When the LED module emits light and generates heat, the heat sink will absorb the heat generated by the LED module. In the meantime, the fan operates to forcedly drive airflow from the air inlet into the light seat and then drive the airflow to multiple radiating fins of the heat sink so as to directly carry the heat from the radiating fins to outer side through the air outlet. Accordingly, the heat dissipation effect is enhanced and the noise is reduced.

In the above heat dissipation structure for LED lighting, a third open end is disposed around the first open end of the cap body. The third open end extends from an outer circumference of the first open end. The third open end is positioned at a height higher than the air outlet, whereby the third open end can effectively prevent alien articles from directly entering the cap body. Accordingly, the operation of the fan is prevented from being affected by alien articles.

In the above heat dissipation structure for LED lighting, a slope section is formed between the cap body and the third open end. The slope section can effectively guide the airflow to lower the wind pressure at the air outlet and increase air volume.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1A:
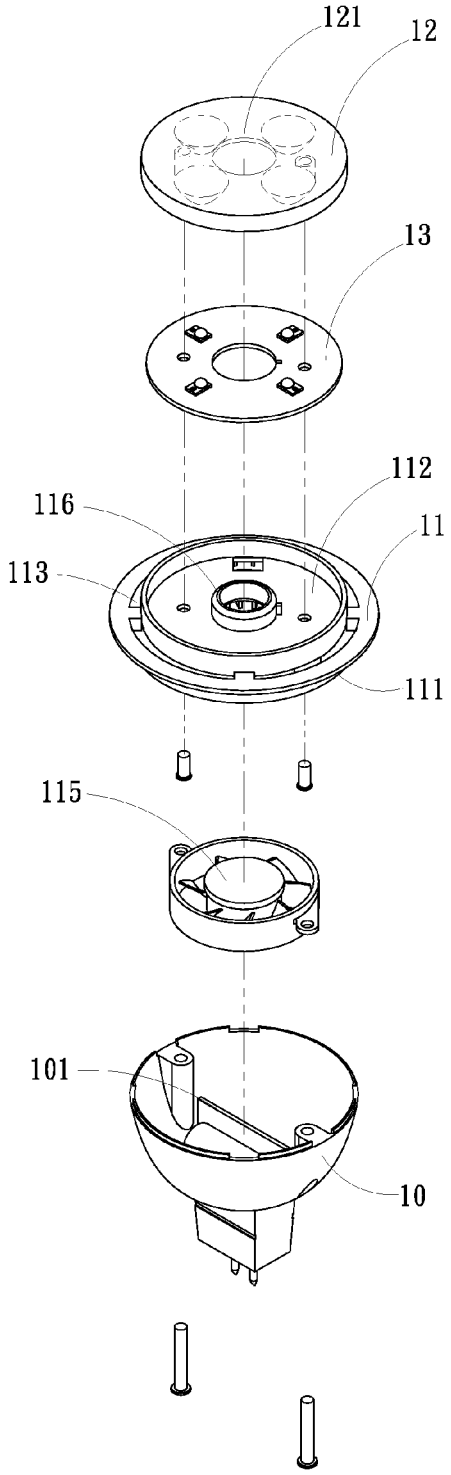
(PRIOR ART) Fig. 1a
FIG. 1*a* is a perspective exploded view of a conventional heat dissipation structure for LED lighting.
Figure 1B:
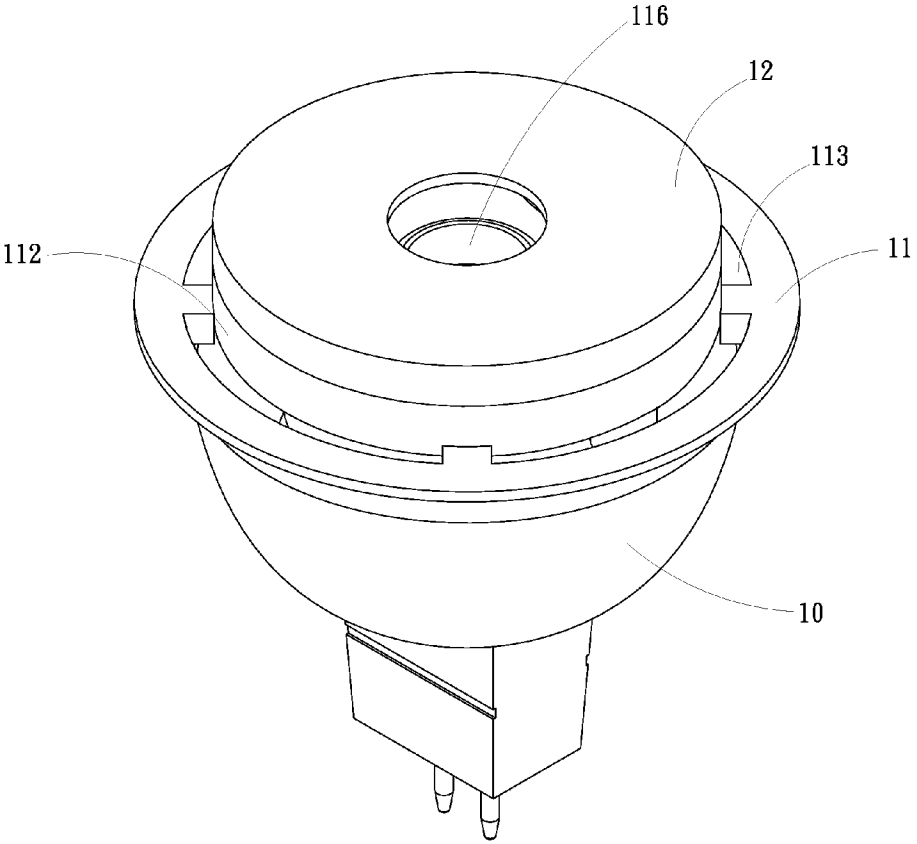
(PRIOR ART) Fig. 1b
FIG. 1*b* is a perspective assembled view of the conventional heat dissipation structure for LED lighting.
Figure 1C:
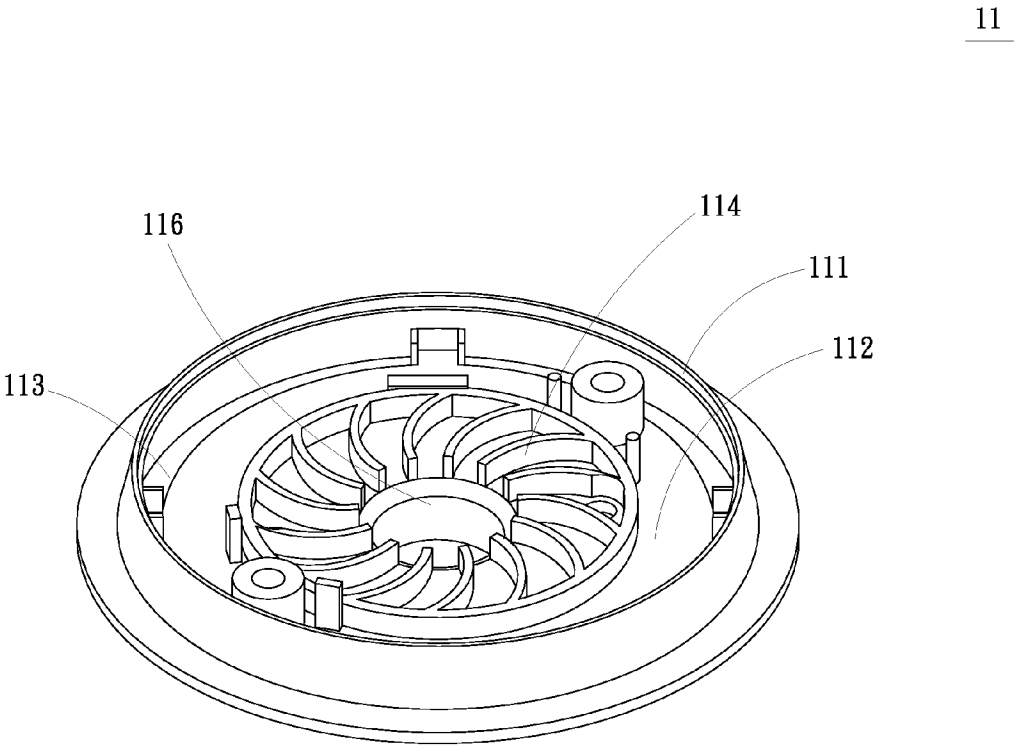
(PRIOR ART) Fig. 1c
FIG. 1*c* is a perspective view of a part of the conventional heat dissipation structure for LED lighting, seen from another angle.
Figure 1D:
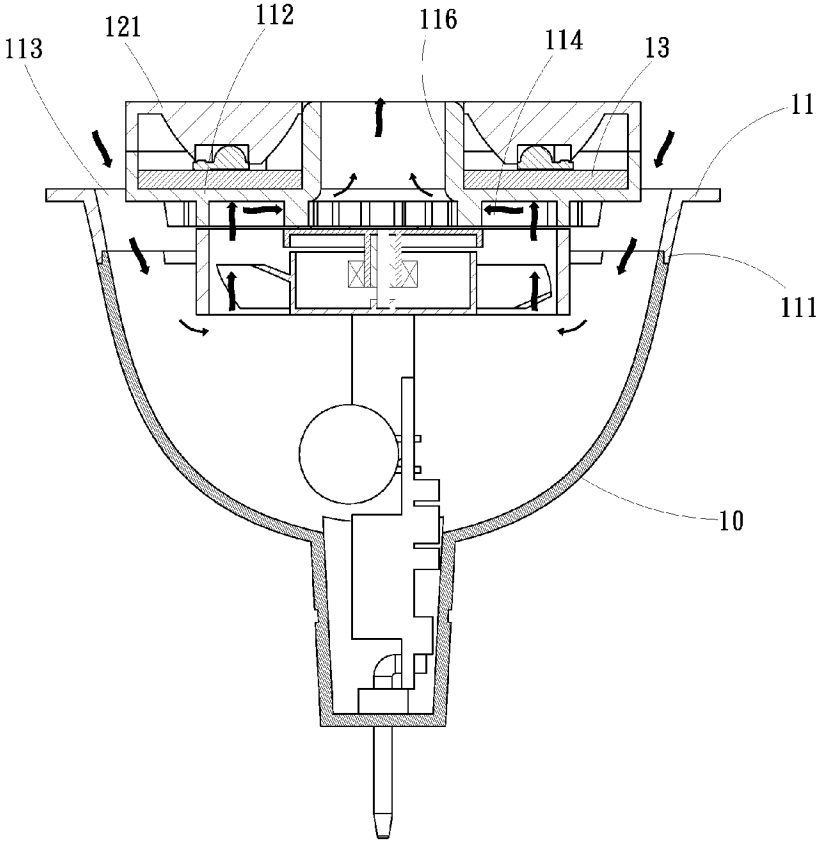
(PRIOR ART) Fig. 1d
FIG. 1*d* is a sectional view showing the operation of the conventional heat dissipation structure for LED lighting.
Figure 2A:
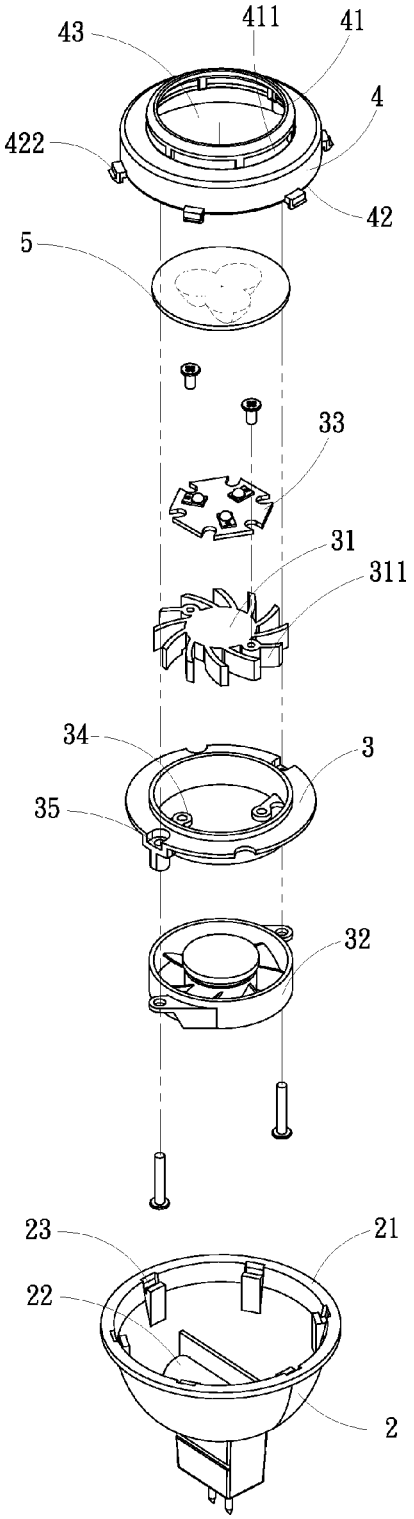
FIG. 2*a* is a perspective exploded view of a first embodiment of the heat dissipation structure for LED lighting of the present invention.
Figure 2B:
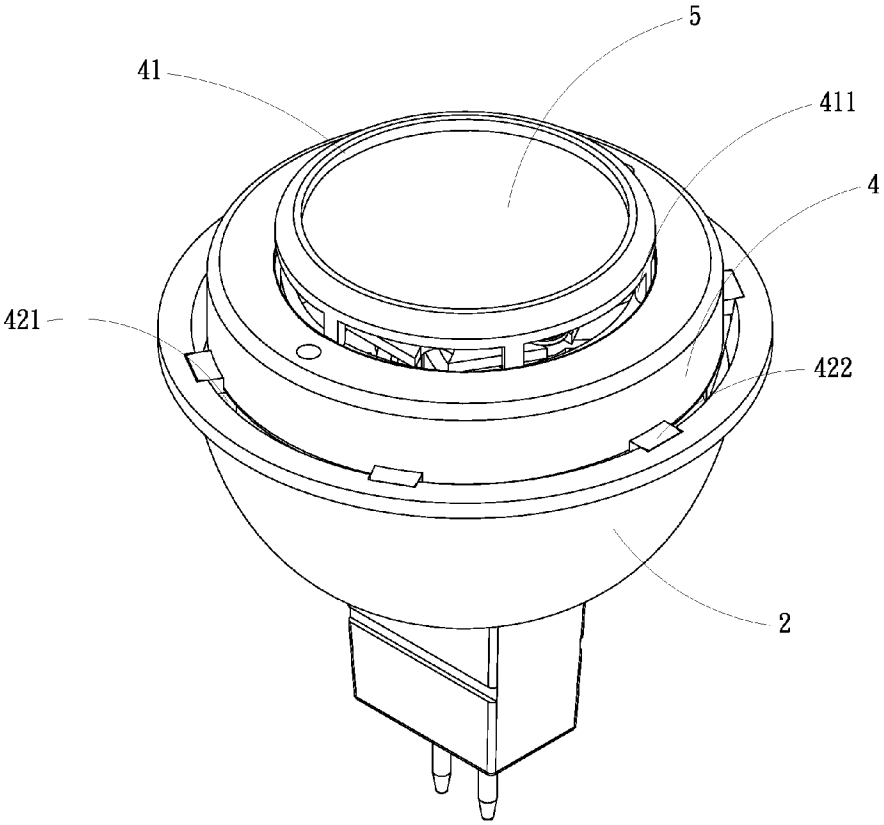
FIG. 2*b* is a perspective assembled view of the first embodiment of the heat dissipation structure for LED lighting of the present invention.

Please refer to FIGS. 2*a* and 2*b*. FIG. 2*a* is a perspective exploded view of a first embodiment of the heat dissipation structure for LED lighting of the present invention. FIG. 2*b* is a perspective assembled view of the first embodiment of the heat dissipation structure for LED lighting of the present invention. According to the first embodiment, the heat dissipation structure for LED lighting of the present invention includes a light seat 2, a support body 3, a cap body 4 and a lens 5. One side of the light seat 2 is formed with an opening 21. A drive module 22 is disposed in the light seat 2. The support body 3 is disposed in the opening 21 of the light seat 2. A heat sink 31 and a fan 32 are respectively assembled and disposed on two sides of the support body 3. An LED module 33 is assembled and disposed on one side of the heat sink 31 opposite to the fan 32. The cap body 4 is capped on the support body 3 and disposed in the opening 21 of the light seat 2. The cap body 4 has a first open end 41 and a second open end 42. A receiving space 43 is defined between the first and second open ends 41, 42. At least one air outlet 411 is formed on the cap body 4 in adjacency to the first open end 41 in communication with the receiving space 43. At least one air inlet 421 is formed at the second open end 42. The lens 5 is disposed in the first open end 41 to block the same.

Multiple latch members 422 extend from the second open end 42. The latch members 422 are engaged with multiple latch sections 23 of the light seat 2 to define the air inlet 421. The support body 3 is disposed in the receiving space 43 and has at least one first fixing section 34 and at least one second fixing section 35. The first fixing section 34 is for affixing the heat sink 31 and the LED module 33 between the support body 3 and the cap body 4. The LED module 33 is correspondingly connected with the lens 5. The second fixing section 35 is for affixing the fan 32 between the support body 3 and the light seat 2 and for affixing the cap body 4.

Figure 2C:
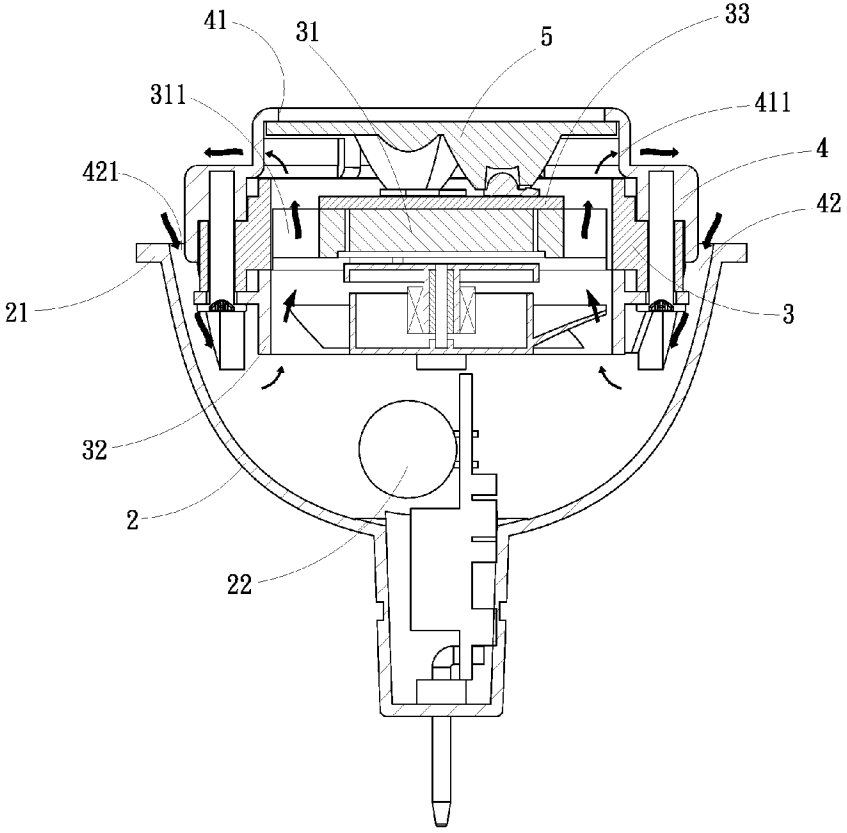
FIG. 2*c* is a sectional view showing the operation of the first embodiment of the heat dissipation structure for LED lighting of the present invention.

Please now refer to FIG. 2*c*, which is a sectional view showing the operation of the first embodiment of the heat dissipation structure for LED lighting of the present invention. When the LED module 33 emits light and generates heat, the heat sink 31 will absorb the heat generated by the LED module 33. In the meantime, the fan 32 operates to create airflow and forcedly drive air from the air inlet 421 into the light seat 2. Then the fan 32 further creates airflow and drives the airflow to multiple radiating fins 311 of the heat sink 31 so as to directly carry the heat from the radiating fins 311 to outer side through the air outlet 411. Accordingly, the heat dissipation effect can be enhanced to avoid deterioration of the illumination of the LED lighting and prolong the lifetime of the LED lighting. The blades of the fan 32 can directly blow airflow to the radiating fins 311 without being obstructed by the heat sink 31 so that the noise is reduced.

Figure 3A:
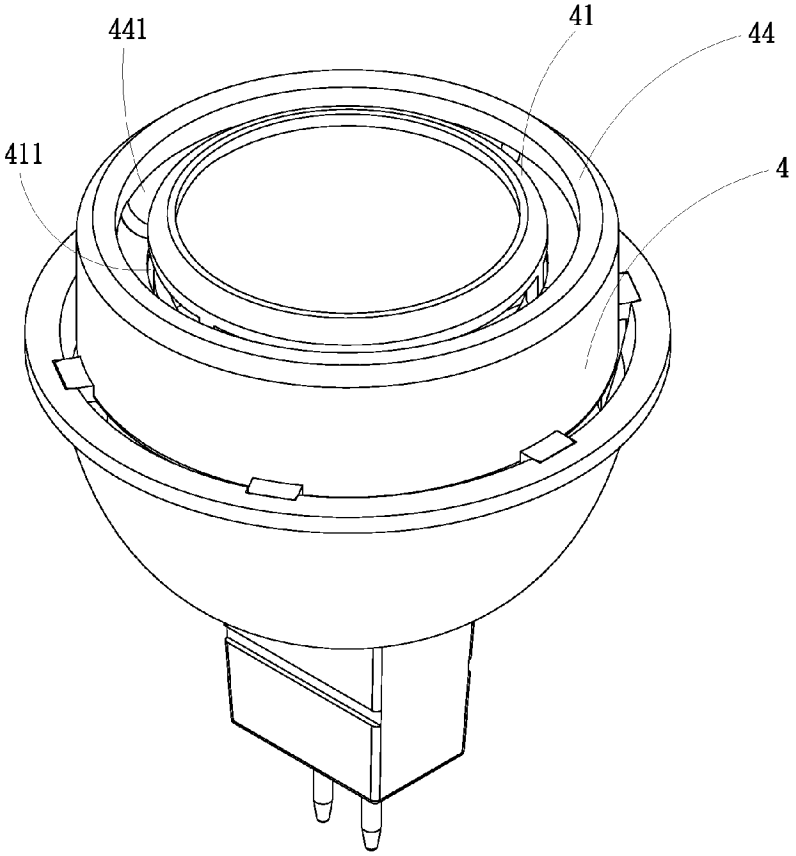
FIG. 3*a* is a perspective assembled view of a second embodiment of the heat dissipation structure for LED lighting of the present invention.
Figure 3B:
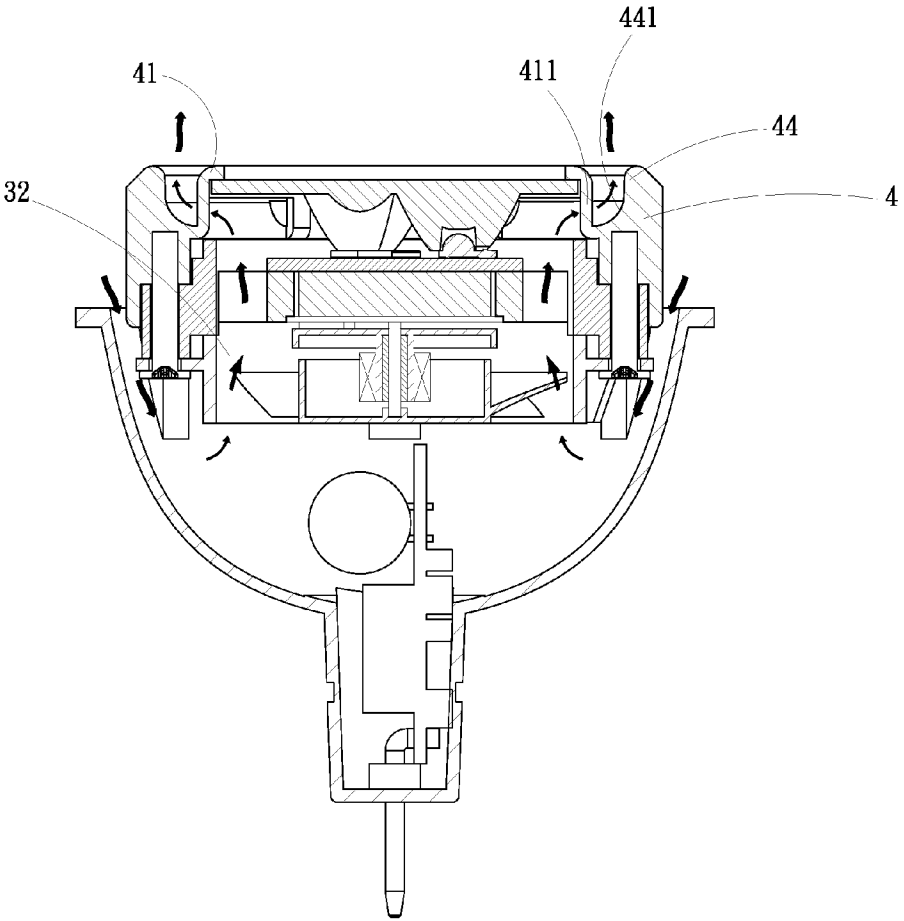
FIG. 3*b* is a sectional view showing the operation of the second embodiment of the heat dissipation structure for LED lighting of the present invention.

Please now refer to FIGS. 3*a* and 3*b*. FIG. 3*a* is a perspective assembled view of a second embodiment of the heat dissipation structure for LED lighting of the present invention. FIG. 3*b* is a sectional view showing the operation of the second embodiment of the heat dissipation structure for LED lighting of the present invention. The second embodiment is substantially identical to the first embodiment in structure and connection relationship between the components and thus will not be repeatedly described hereinafter. The second embodiment is different from the first embodiment in that a third open end 44 is disposed around the first open end 41 of the cap body 4. The third open end 44 extends from an outer circumference of the first open end 41. The third open end 44 is positioned at a height higher than the air outlet 411, whereby the third open end 44 can effectively prevent alien articles from directly entering the cap body 4. Accordingly, the operation of the fan 32 is prevented from being affected by alien articles and the air outlet 411 is kept free for exhausting the air. Furthermore, a slope section 441 is formed between the third open end 44 and the cap body 4. The slope section 441 is positioned at the air outlet 411, whereby when the air is exhausted from the air outlet 411, the slope section 441 can effectively guide the airflow to lower the wind pressure at the air outlet 411 and increase air volume.

Figure 4A:
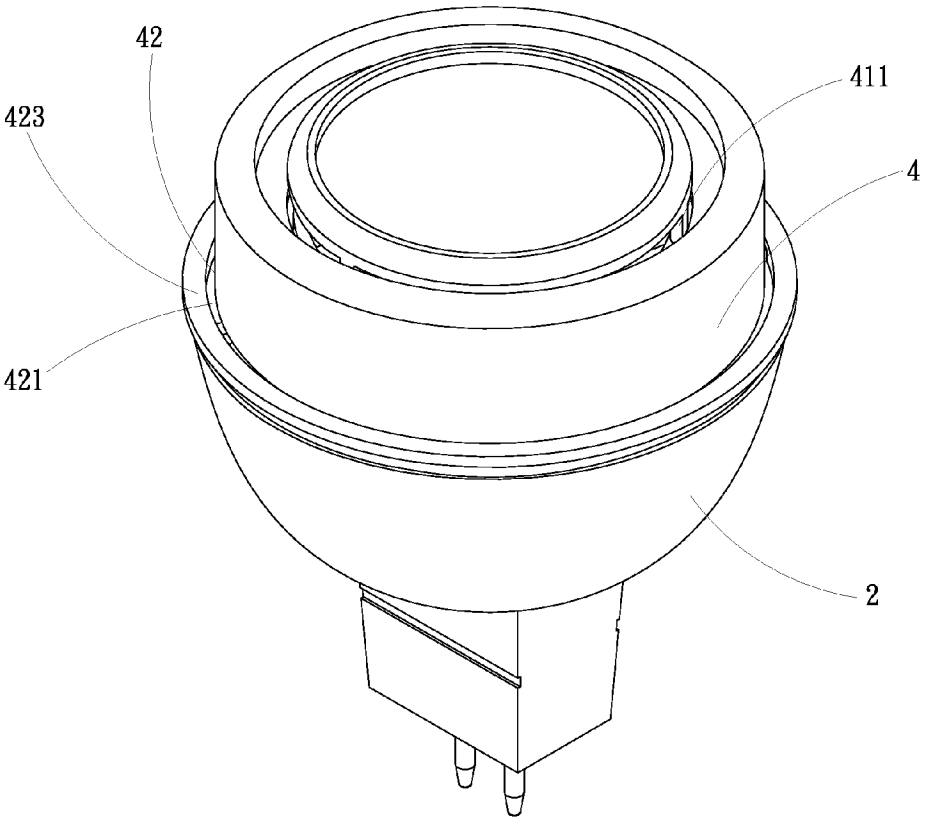
FIG. 4*a* is a perspective assembled view of a third embodiment of the heat dissipation structure for LED lighting of the present invention.
Figure 4B:
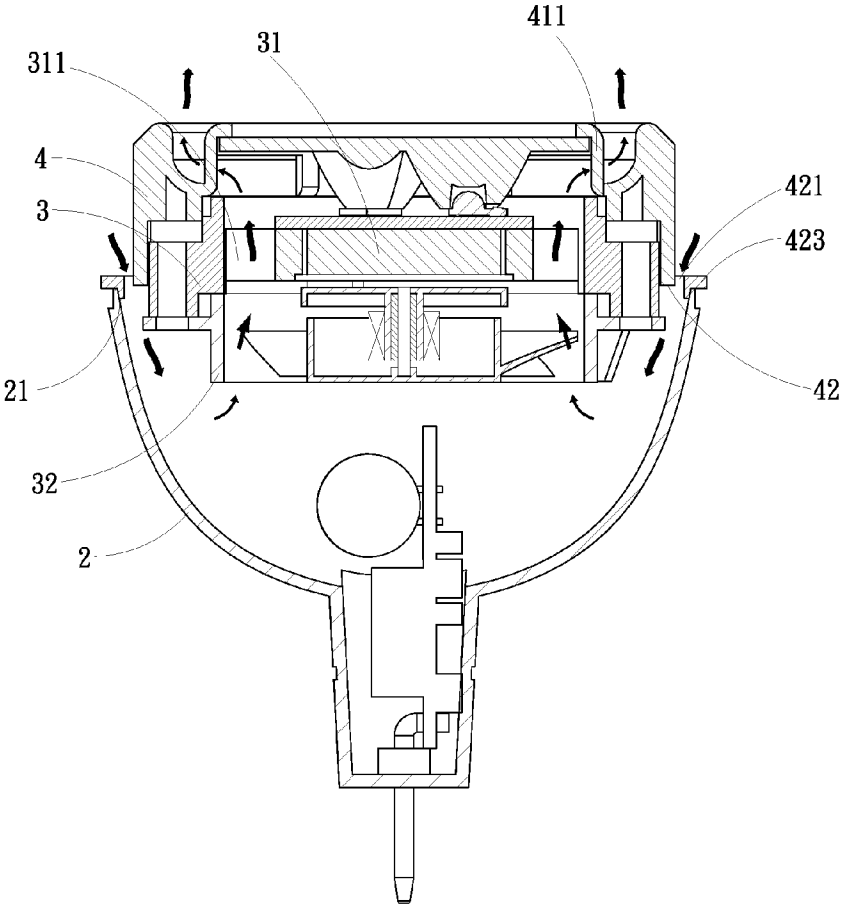
FIG. 4*b* is a sectional view showing the operation of the third embodiment of the heat dissipation structure for LED lighting of the present invention.

Please now refer to FIGS. 4*a* and 4*b*. FIG. 4*a* is a perspective assembled view of a third embodiment of the heat dissipation structure for LED lighting of the present invention. FIG. 4*b* is a sectional view showing the operation of the third embodiment of the heat dissipation structure for LED lighting of the present invention. The third embodiment is substantially identical to the second embodiment in structure and connection relationship between the components and thus will not be repeatedly described hereinafter. The third embodiment is different from the second embodiment in that at least one extension section 423 outward extends from the second open end 42. The air inlet 421 is defined between the extension section 423 and the second open end 42. The cap body 4 is capped on the support body 3 and assembled with the opening 21 of the light seat 2 with the extension section 423 engaged with the light seat 2. When the fan 32 operates, the fan 32 creates airflow and forcedly drives air from the air inlet 421 into the light seat 2. Then the fan 32 further creates airflow and drives the airflow to the multiple radiating fins 311 of the heat sink 31 so as to directly carry the heat from the radiating fins 311 to outer side through the air outlet 411. Accordingly, the heat dissipation effect can be enhanced. The blades of the fan 32 can directly blow airflow to the radiating fins 311 without being obstructed by the heat sink 31 so that the noise is reduced.

According to the above, in comparison with the conventional heat dissipation structure for LED lighting, the present invention has the following advantages:

1. The heat dissipation effect is enhanced.
2. The noise is reduced.
3. The illumination of the LED lighting will not be deteriorated and the lifetime of the LED lighting is prolonged.
4. The alien articles are prevented from entering the cap body.

The above embodiments are only used to illustrate the present invention, not intended to limit the scope thereof. It is understood that many changes and modifications of the above embodiments can be made without departing from the spirit of the present invention. The scope of the present invention is limited only by the appended claims.

What is claimed is:

1. A heat dissipation structure for LED lighting, comprising:

a light seat formed with an opening and comprising multiple latch sections in the opening;

a support body disposed in the opening of the light seat and having a passageway, a heat sink and a fan in the passageway being assembled and disposed on two sides of the support body, the passageway being used for guiding airflow created by the fan, an LED module being assembled and disposed on the heat sink;

a cap body capped on one side of the support body to communicate with the passageway and disposed in the opening of the light seat, the cap body having a first open end and a second open end, at least one air outlet being formed on the cap body in adjacency to the first open end to communicate with the passageway of the support body, and wherein multiple latch members extend outward from the second open end, the latch members being engaged with multiple latch sections of the light seat to define at least one air inlet between the cap body and the light seat, the air inlet being communicated with the passageway of the support body; and a lens disposed in the first open end; and wherein the support body has at least one first fixing section and at least one second fixing section, the first fixing section being for affixing the heat sink and the LED module, the second fixing section being for affixing the fan and the cap body;

wherein the least one air inlet and the at least one air outlet both are located at a front side of the light seat, and a location of the at least one air outlet is higher than a location of the at least one air inlet;

wherein an outlet passage is formed from the fan and the at least one air inlet and an inlet passage is formed from the at least one air inlet to the fan and the at least one air inlet is outside of and surrounds the outlet passage, the inlet passage being shorter than the outlet passage.

2. The heat dissipation structure for LED lighting as claimed in claim 1, wherein a third open end is disposed around the first open end of the cap body, the third open end extending from an outer circumference of the first open end, the third open end being positioned at a height higher than the air outlet.

3. The heat dissipation structure for LED lighting as claimed in claim 2, wherein a slope section is formed between the third open end and the cap body.

4. The heat dissipation structure for LED lighting as claimed in claim 1, wherein at least one drive module is disposed in the light seat.

5. The heat dissipation structure for LED lighting as claimed in claim 1, wherein the heat sink is disposed between the support body and the cap body and the LED module assembled on the heat sink is correspondingly connected with the lens.

6. The heat dissipation structure for LED lighting as claimed in claim 1, wherein the fan is disposed between the support body and the light seat.

7. The heat dissipation structure for LED lighting as claimed in claim 1, wherein at least one extension section outward extends from the second open end, the air inlet being defined between the extension section and the second open end.

8. The heat dissipation structure for LED lighting as claimed in claim 1, wherein a receiving space is defined between the first and second open ends, the support body being disposed in the receiving space.

* * * * *